United States Patent [19]

Kodet et al.

[11] 4,302,857

[45] Dec. 1, 1981

[54] BASSINET

[75] Inventors: Reuben P. Kodet; Wayne E. Kohlmeier; Willard A. Schuster, all of Manitowoc, Wis.

[73] Assignee: American Hospital Supply Corporation, Evanston, Ill.

[21] Appl. No.: 56,677

[22] Filed: Jul. 11, 1979

[51] Int. Cl.[3] ..... A47D 13/00; A47B 67/00

[52] U.S. Cl. ..... 5/2 R; 5/93 R; 312/250

[58] Field of Search ..... 49/363, 366, 367, 381, 49/383, 394, 402; 296/50, 55, 146, 183; 5/2 R, 86, 93, 94; 220/335; 312/249, 250, 138, 139; 4/177

[56] References Cited

U.S. PATENT DOCUMENTS

| | | | |
|---|---|---|---|
| 2,654,098 | 10/1953 | Heyward | 5/93 R |
| 2,752,614 | 7/1956 | Hayward | 5/93 R |
| 2,968,507 | 1/1961 | Montgomery | 49/394 |
| 3,093,836 | 6/1963 | Christensen et al. | 5/60 |
| 3,351,380 | 11/1967 | Sprague | 5/94 |
| 3,564,771 | 2/1971 | Reynolds | 49/383 |
| 3,631,547 | 1/1972 | Massie | 5/93 R |
| 3,931,652 | 1/1976 | Navarra | 4/177 |

FOREIGN PATENT DOCUMENTS

| | | | |
|---|---|---|---|
| 1953581 | 10/1969 | Fed. Rep. of Germany | 4/177 |

*Primary Examiner*—Roy D. Frazier

*Attorney, Agent, or Firm*—Larry N. Barger; Donald L. Barbeau

[57] ABSTRACT

An infant bathing bassinet with a wheeled tub support and a wheeled supply cabinet that nests with this tub support from a frontal direction. A coupler temporarily joins the tub support and supply cabinet so they can be wheeled about as a unit. The supply cabinet has a pair of openable front doors which can widely swing open through an angle of approximately 270° without interferring with the tub support structure.

22 Claims, 11 Drawing Figures

BASSINET

BACKGROUND

Wheeled tub supports for infant bathing bassinets have been known. One such tub support has included a cantilevered top for moving the tub support over a counter top or table when washing an infant. However, when the tub support was rolled away from the counter top or table, such as when moving an infant to a different wing of a hospital, it was a tedious process for a nurse to carry all of the washing supplies, diapers, etc. while moving the tub support.

It has been proposed in the past to attach a portable supply cabinet to the tub support. However, such supply cabinets have been inserted into the tub support from a side direction, and vertical columns of the tub support severely restricted the frontal access to any supply cabinet. Frontal doors of such supply cabinets when fully opened remained in the way of the nurse or physician tending the infant. Because such doors were sticking out when they were opened, it was difficult to move the combined tub support and cabinet through narrow doors, etc. without catching the open doors. Also, such limited movement of frontal doors caused by the side nesting of prior bassinets caused additional problems in automatic spray washing machines for carts and bassinets.

SUMMARY OF THE INVENTION

The present invention overcomes the above problems by providing a unique tub support and supply cabinet combination which is readily nestable, and yet provides full frontal access to the supply cabinet through doors that can widely open without interference from the tub support structure. The tub support includes a forwardly cantilevered top for the infant bathing tub and a wheeled U-shaped base joined to the top through a vertical back support. The wheeled supply cabinet nests into the tub support from a frontal direction, and the tub support is free of structure at its front and sides which could interfere with free swinging of frontal doors on the supply cabinet. Preferably, the supply cabinet has a pair of front opening doors, each of which can open through an arcuate swing of approximately 270° angle. A multi-position latch system holds the doors away from sides of the cabinet when the cabinet is moved through a spray washer to cleanse the entire cabinet.

THE DRAWINGS

DETAILED DESCRIPTION

Figure 1:
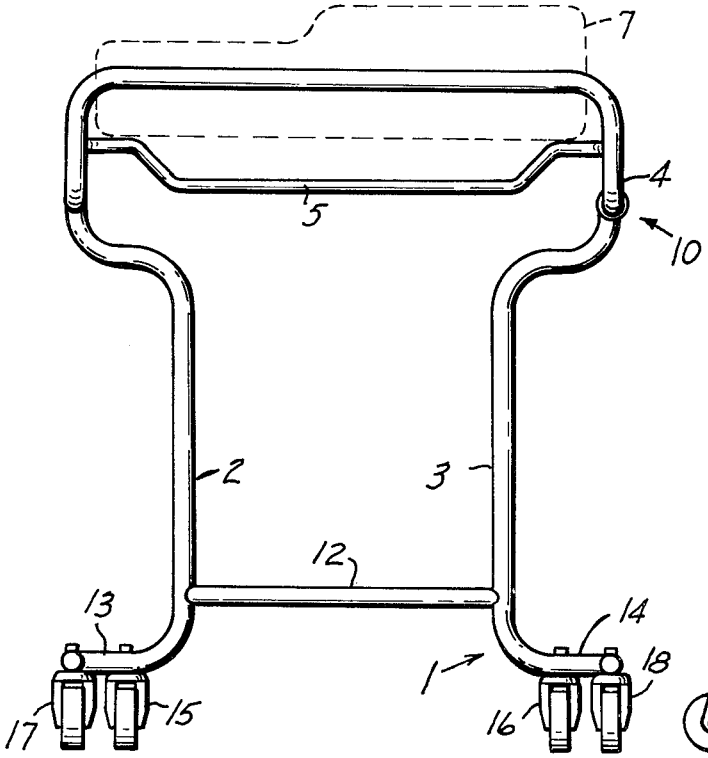
FIG. 1 is a front elevational view of the wheeled tub support.

FIG. 1 shows the tub support which includes a wheeled base 1 with a pair of vertical supports 2 and 3 which connect with a forwardly extending cantilevered top 4. A pair of support rods 5 and 6 support an infant bathing tub 7 shown in dotted line. By sliding the tub slightly to the left in FIG. 1, the right end of the tub can be lowered into a central underslung area of the support rods 5 and 6. Conversely, by moving the tub to the right, its left end can be lowered into the underslung area. This tub tilting feature has been used in the past with other bassinets and does not form part of this invention.

Figure 2:
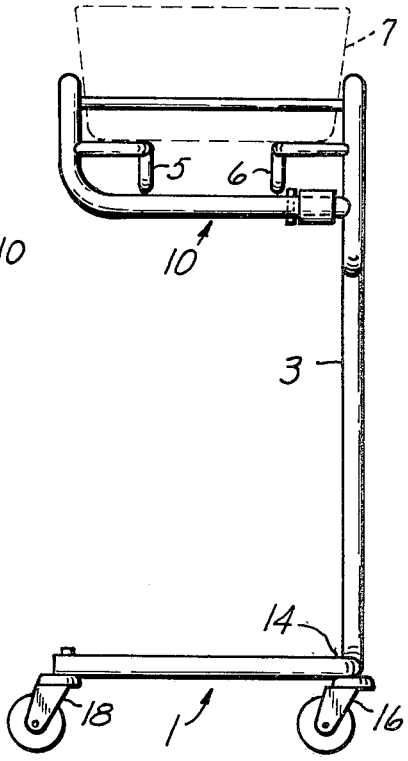
FIG. 2 is a right end elevational view of the tub support.

As best seen in FIG. 2, the entire tub supporting top shown generally at 10 is cantilevered in a forward direction from the vertical supports 2 and 3. A transverse brace 12 combines with spaced apart arms 13 and 14 to give the base, shown generally at 1, a generally U-shape. At the back of the U-shaped base are a pair of casters 15 and 16, while at its front are a pair of casters 17 and 18. Preferably, two of the four casters are stationary, while the other two are of the swivel type. However, if desired, all casters could be swivel type.

Figure 3:
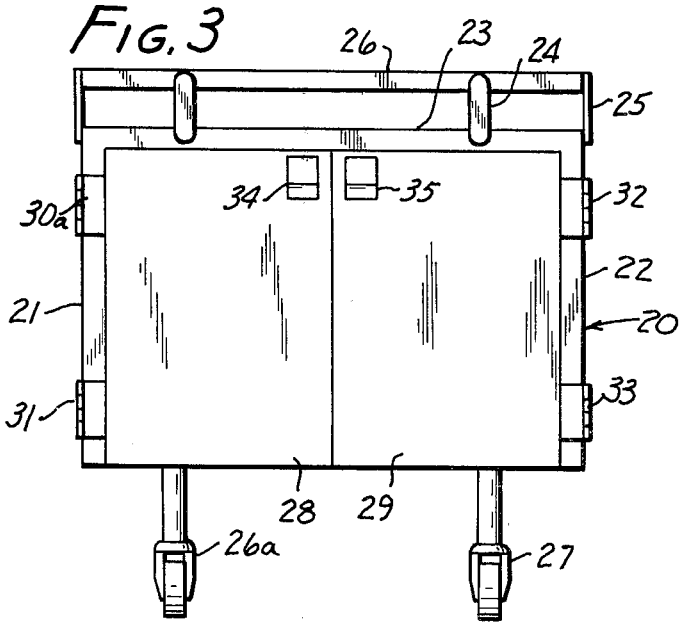
FIG. 3 is a front elevational view of the wheeled supply cabinet.
Figure 4:
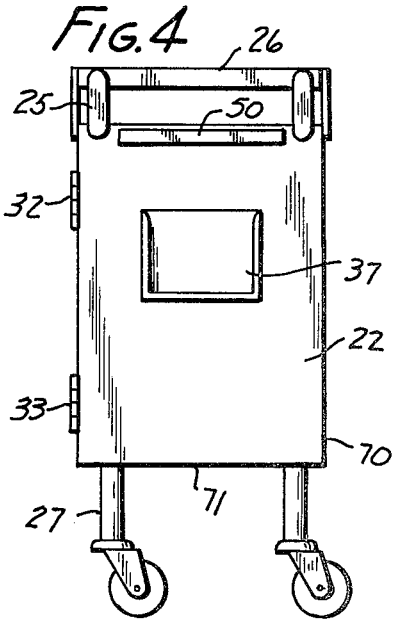
FIG. 4 is a right end elevational view of the supply cabinet.

In the frontal view of FIG. 3, a supply cabinet 20 is shown which includes a pair of side walls 21 and 22 and a top 23. Connected to the top are a series of upstanding posts 24 and 25 which support a railing 26 about the periphery of the cabinet top 3. The cabinet is supported by casters, such as 26*a* and 27. As seen in FIGS. 3 and 4 there are four such casters. The cabinet also has a back wall 70 and a bottom 71 as shown in FIG. 4.

The cabinet has a pair of frontal opening members, such as doors 28 and 29 with hinges 30*a*, 31, 32, and 33. Hand operated latches 34 and 35 maintain the doors in closed position. If desired, a cardholder 37 for a patient record can be secured to the cabinet.

Figure 5:
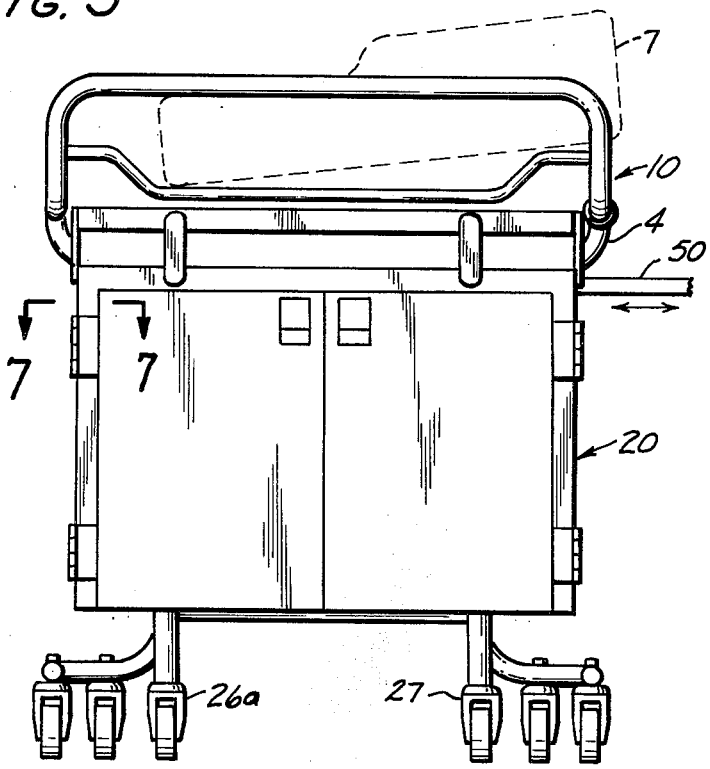
FIG. 5 is a front elevational view of the supply cabinet nested with the tub support.
Figure 6:
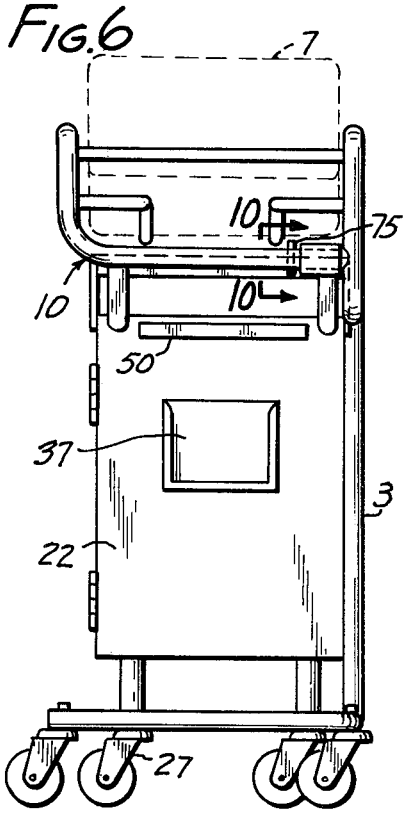
FIG. 6 is a right end elevational view of the nested supply cabinet and tub support.

In FIGS. 1-4, the tub support and supply cabinet are shown separately, in FIG. 5, the supply cabinet is shown nested into the tub support from a frontal direction. As can be seen, the casters of the supply cabinet fit inside the generally U-shaped base of the tub support. The vertical member 3 as shown in FIG. 6 is behind the supply cabinet 20. Also, the top 10 of the tub support is cantilevered over the top of the supply cabinet. As best seen in FIG. 6, the entire right side 22 of the supply cabinet is unencumbered by supporting structure of the tub support. This is important for providing very wide opening of the cabinet doors so they can be swung out of the way of the nurse or physician tending the infant.

Figure 7:
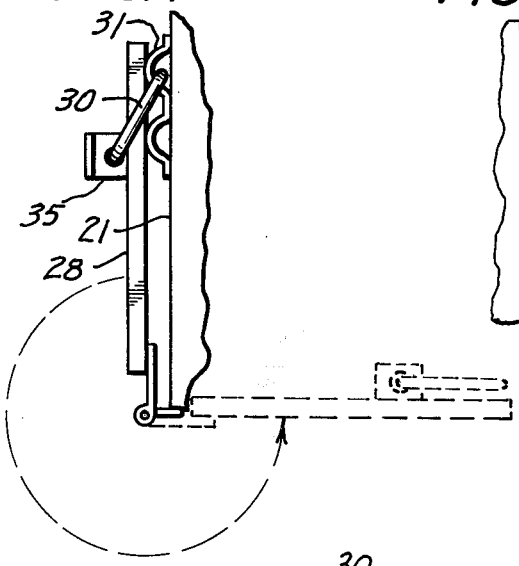
FIG. 7 is a view taken along line 7—7 showing the frontal door of the supply cabinet in fully opened condition (solid line) and fully closed position (dotted line)

As shown in FIG. 7, door 28 has been swung from its closed position (shown in dotted line) through an arc of approximately 270° where it is approximately parallel to the left side 21 of the cabinet. Here a latch member 30 is secured into a loop 31 to hold the door in this position.

Figure 9:
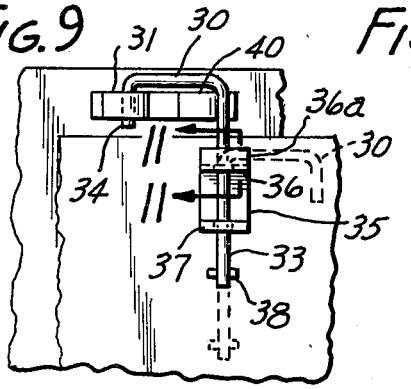
FIG.9 is a fragmentary left elevational view showing the latch structure which holds the door open in FIG. 7.
Figure 8:
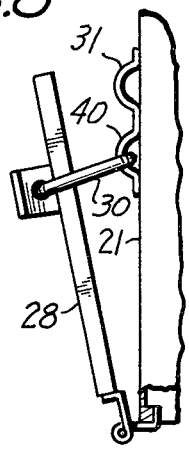
FIG. 8 is a view similar to FIG. 7, but showing a plural position door latch holding the door in an angular position relative to the cabinet side.
Figure 11:
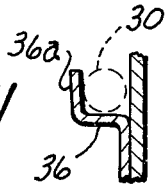
FIG. 11 is a sectional view taken along line 11—11 of FIG. 9.

The latch structure can best be described by referring to FIG. 9. Here the latch 30 has an elongated support arm 33 and a pocket arm 34 which gives the latch member an inverted J-shape. As shown in FIG. 9, the pocket arm is fitted into loop 31, while elongated arm 33 is positioned in support lug 35 secured to the door. Support lug 35 has flanges 36 and 37 with holes for receiving arm 33. Such holes are larger in diameter than arm 33 so the latch member can slide up and down to remove it from loop 31. A retainer pin 38 prevents the latch from being pulled out of the support lug 35. Flange 36 has an upstanding lip 36*a* which holds the latch 30 in stowage position when not in use as shown in dotted line and in FIG. 11.

When it is desired to push the entire supply cart through a cart washing machine, the door 28 is preferably spaced from the side wall 21 at an angle of 5° to 30°. This is so water spray can reach all surface areas of door 28. To hold door 28 in this position, latch member 30 is positioned in loop 40.

Figure 10:
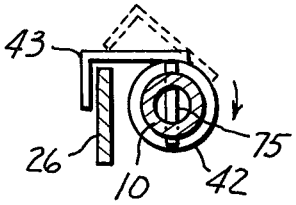
FIG. 10 is a sectional view taken along line 10—10 of FIG. 6 showing the coupling means to join the nested supply cabinet and tub support.

In FIG. 10, a swivel lock is shown which couples the cantilevered top 10 of the tub support to a rail 26 of the supply cabinet. This swivel lock includes a rotatable coller 42 on a tubular member of the cantilevered top. Collar 42 is secured to a hook member 42 that overlappingly secures the rail 26 of the cabinet to the tub support. When desired to disconnect the cabinet from the tub support, the swivel lock is pivoted as shown in dotted line and the cabinet rolled out in a forward direction from the tub support. Preferably, there is a swivel lock, such as shown in FIG. 10, at each end of the bassinet. A stud, such as 75, shown in FIGS. 6 and 10 prevents longitudinal sliding of the collar along cantilevered top 10.

When the tub support and supply cabinet are connected as shown in FIG. 5, there is sometimes a need for additional table space for soap, diapers, etc. A retractable shelf 50 provides such additional working surface without interferring with the compact mobile structure of the bassinet. When not in use, the retractable shelf slides into a cavity of the supply cabinet. A retractable shelf could be included on either or both sides of the cabinet.

In the foregoing description, specific examples have been used to describe the invention. However, it is understood by those skilled in the art that certain modifications can be made to these examples without departing from the spirit and scope of invention.

We claim:

1. A bassinet with a tub support having a wheeled base and a forwardly cantilevered top; a wheeled support cabinet adapted to nest with the tub support from a frontal direction; a frontal openable member on a front of the supply cabinet; and a coupling means to temporarily join the supply cabinet and support so that they move as a unit.

2. A bassinet as set forth in claim 1, wherein the frontal opening member is a door.

3. A bassinet as set forth in claim 2, wherein the door swings on a vertical axis and is capable of moving more than 180° about such axis to minimize interference with such door during use of the bassinet.

4. A bassinet as set forth in claim 3, wherein the door can swing through approximately 270° and be positioned generally parallel to sides of the cabinet.

5. A bassinet as set forth in claim 4, wherein the door has a latch means holding the door in such position.

6. A bassinet as set forth in claim 3, wherein the door has a latch which holds the door at an angle from 5° to 30° from the cabinet side for washing.

7. A bassinet as set forth in claim 2, wherein there are a plurality of openable doors on a front of the cabinet.

8. A bassinet as set forth in claim 2, wherein the cabinet has a rack on its top for holding supplies after they have been removed from the cabinet.

9. A bassinet as set forth in claim 8, wherein the rack includes a rail about a peripheral edge of the cabinet top.

10. A bassinet as set forth in claim 9, wherein the coupling means engages this rail.

11. A bassinet as set forth in claim 2, wherein the coupling means includes a swivel lock mounted on the cabinet or tub support.

12. A bassinet as set forth in claim 11, wherein the swivel lock is mounted on a generally horizontal member of the support, and includes a hook portion for engaging the cabinet.

13. A bassinet as set forth in claim 12, wherein the swivel lock includes a tubular element connected to a hook portion.

14. A bassinet as set forth in claim 13, wherein the cabinet has an upstanding rail and the lock's hook portion engages this cabinet rail.

15. A bassinet as set forth in claim 11, wherein there are a plurality of such swivel locks.

16. A bassinet as set forth in claim 2, wherein the support has a generally U-shaped base for receiving the cabinet.

17. A bassinet as set forth in claim 2, which includes means to angularly position a bathing tub in a plurality of positions without interferring with the cabinet.

18. A bassinet as set forth in claim 17, wherein there is a bathing tub spaced above the cabinet.

19. A bassinet as set forth in claim 2, wherein the cabinet can be disconnected from the tub support and the cantilevered top of the tub support moved over a table top.

20. A bassinet as set forth in claim 2, wherein the supply cabinet has a retractable shelf.

21. A bassinet with a tub support and a separate nestable supply cabinet, said tub support comprising a frontal nesting structure adapted to receive said supply cabinet therein, said supply cabinet having a front opening door, whereby said supply cabinet is adapted to be independently disposed in a nesting position within said frontal nesting structure of said tub support with said door opening toward the front of said supply cabinet and said tub support.

22. A bassinet as set forth in claim 21, wherein said tub support has a cantilevered top such that said door can swing more than 180° without interfering with the tub support.

* * * * *